US008395307B2

(12) United States Patent
Suzuki et al.

(10) Patent No.: US 8,395,307 B2
(45) Date of Patent: Mar. 12, 2013

(54) SPARK PLUG FOR PREVENTING ACCUMULATION OF CARBON ON AN INSULATOR

(75) Inventors: Akira Suzuki, Nagoya (JP); Tomoaki Kato, Nagoya (JP); Mamoru Musasa, Hurricane, WV (US); Toshitaka Honda, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 22 days.

(21) Appl. No.: 13/142,893

(22) PCT Filed: Dec. 7, 2009

(86) PCT No.: PCT/JP2009/070455

§ 371 (c)(1),
(2), (4) Date: Jun. 30, 2011

(87) PCT Pub. No.: WO2010/082409

PCT Pub. Date: Jul. 22, 2010

(65) Prior Publication Data

US 2011/0266940 A1 Nov. 3, 2011

(30) Foreign Application Priority Data

Jan. 13, 2009 (JP) ..... 2009-004313

(51) Int. Cl.
*H01T 13/20* (2006.01)

(52) U.S. Cl. ..... 313/141; 313/118; 313/143

(58) Field of Classification Search ..... 313/140–143; 445/7

See application file for complete search history.

(56) References Cited

U.S. PATENT DOCUMENTS

2008/0042539 A1 2/2008 Walker

FOREIGN PATENT DOCUMENTS

| | | |
|---|---|---|
| JP | 09-045457 | 2/1997 |
| JP | 2000-243535 A | 9/2000 |
| JP | 2001-176637 A | 6/2001 |
| JP | 2003-303661 | 10/2003 |
| JP | 2006-236906 | 9/2006 |
| WO | WO 2007/149772 A | 12/2007 |

OTHER PUBLICATIONS

International Search Report mailed Feb. 23, 2010 for the corresponding PCT application No. PCT/JP2009/070455.

*Primary Examiner* — Joseph L Williams
(74) *Attorney, Agent, or Firm* — Leason Ellis LLP.

(57) ABSTRACT

A spark plug which provides reliable prevention of adhesion and accumulation of carbon on an insulator, includes a center electrode extending in the direction of an axis CL1, a ceramic insulator having an axial hole which extends in the direction of the axis CL1 and in which the center electrode is provided, a cylindrical metallic shell provided externally of the outer circumference of the insulator and having a support portion formed on the inner circumferential surface thereof, and a ground electrode extending from a front end portion of the metallic shell. The insulator has a stepped portion supported by the support portion of the metallic shell, and a leg portion formed forward of the stepped portion. A space SP formed between the leg portion of the insulator and the inner circumferential surface of the metallic shell has a volume of 100 $mm^3$ to 300 $mm^3$ inclusive.

16 Claims, 5 Drawing Sheets

SPARK PLUG FOR PREVENTING ACCUMULATION OF CARBON ON AN INSULATOR

CROSS-REFERENCE TO RELATED PATENT APPLICATIONS

This application is a U.S. National Phase Application under 35 U.S.C. §371 of International Patent Application No. PCT/JP2009/070455, filed Dec. 7, 2009, and claims the benefit of Japanese Patent Application No. 2009-004313, filed Jan. 13, 2009, all of which are incorporated by reference herein. The International Application was published in Japanese on Jul. 22, 2010 as International Publication No. WO/2010/082409 under PCT Article 21(2).

FIELD OF THE INVENTION

The present invention relates to a spark plug for use in an internal combustion engine or the like.

BACKGROUND OF THE INVENTION

A spark plug is mounted to, for example, an internal combustion engine and used to ignite air-fuel mixture in a combustion chamber. Generally, a spark plug includes an insulator having an axial hole, a center electrode inserted into the axial hole, a metallic shell provided externally of the outer circumference of the insulator, and a ground electrode provided on the front end surface of the metallic shell and adapted to form a spark discharge gap in cooperation with the center electrode. When the metallic shell and the insulator are assembled together, generally, a stepped portion provided on the inner circumferential surface of the metallic shell and a stepped portion provided on the outer circumferential surface of the insulator butt against each other via a sheet packing made of metal (refer to, for example, Japanese Patent Application Laid-Open (kokai) No. 2003-303661).

In a combustion chamber, carbon is generated as a result of incomplete combustion of air-fuel mixture or the like and may accumulate on the surface of a portion (leg portion) of the insulator exposed to air-fuel mixture and combustion gas. When carbon progressively accumulates on the surface of the leg portion and covers the surface of the leg portion, current may leak from the center electrode to the metallic shell via carbon accumulated on the leg portion, or a spark discharge may be generated between the insulator and the metallic shell, potentially hindering the generation of a normal spark discharge across the spark discharge gap. Particularly, in recent years, in direct-injection engines and the like employed for improvement of fuel economy and output, carbon is more likely to adhere to the insulator, so that the above problem is more likely to occur.

The present invention has been conceived in view of the above circumstances, and an object of the invention is to provide a spark plug which can reliably prevent adhesion and accumulation of carbon onto the insulator for improving resistance to fouling.

SUMMARY OF THE INVENTION

Configurations suitable for solving the above problems will next be described in itemized form. If needed, actions and effects peculiar to the configurations will be additionally described.

Configuration 1. A spark plug of the present configuration comprises a rodlike center electrode extending in a direction of an axis; a tubular insulator having an axial hole which extends in the direction of the axis and in which the center electrode is provided; a cylindrical metallic shell provided externally of an outer circumference of the insulator and having a support portion which is formed on an inner circumferential surface thereof, is in direct or indirect contact with an outer circumferential surface of the insulator, and is adapted to support the insulator; and a ground electrode extending from a front end portion of the metallic shell and defining, in cooperation with the center electrode, a gap between a distal end portion thereof and a front end portion of the center electrode. The insulator has a stepped portion supported by the support portion of the metallic shell, and a leg portion formed forward of the stepped portion along the direction of the axis. The spark plug is characterized in that a space formed between the leg portion of the insulator and the inner circumferential surface of the metallic shell has a volume of 100 $mm^3$ to 300 $mm^3$ inclusive, and a surface of the leg portion has a centerline average roughness of 1.8 μm or less.

Notably, "centerline average roughness" is specified in JIS B0601. Briefly speaking, the total area of regions formed between the outline of a section and the centerline of the outline is calculated within a predetermined length (the distance between the centerline and the outline of the section is integrated over the predetermined length); and the calculated total area is divided by the predetermined length, thereby yielding the centerline average roughness.

Also, a noble metal tip made of a noble metal alloy may be provided at a front end portion of the center electrode and at a distal end portion of the ground electrode. In the case where the center electrode and the ground electrode are provided with respective noble metal tips, the aforementioned gap is formed between the two noble metal tips; and, in the case where merely one of the center electrode and the ground electrode is provided with a noble metal tip, the gap is formed between the noble metal tip provided on one of the two electrodes and an end portion of the other electrode (the same also applies to the following description).

Further, "a space formed between the leg portion of the insulator and the inner circumferential surface of the metallic shell" means a space which is formed between the leg portion and the metallic shell and which, in the case of the spark plug being mounted to, for example, an internal combustion engine, communicates with the internal space of a combustion chamber.

According to configuration 1 mentioned above, the space formed between the leg portion of the insulator and the inner circumferential surface of the metallic shell has a volume (hereinafter, referred to as "gas volume") of 100 $mm^3$ or greater. Thus, a relatively large distance can be ensured between the insulator and the metallic shell, whereby the generation of a spark discharge between the insulator and the metallic shell can be reliably prevented. On the other hand, since the gas volume is specified to be 300 $mm^3$ or less, excessive expansion of an opening portion of the space can be restrained, so that entry of carbon into the space can be restrained.

Further, the leg portion is smoothed such that its surface has a centerline average roughness of 1.8 μm or less. That is, the surface of the leg portion is almost free from such irregularities where carbon is caught or trapped. Therefore, adhesion and accumulation of carbon onto the surface of the leg portion can be reliably prevented.

As mentioned above, the present configuration 1 can drastically improve resistance to fouling through synergy of the above-mentioned actions and effects.

Configuration 2. A spark plug of the present configuration is characterized in that, in configuration 1 mentioned above, the surface of the leg portion has a centerline average roughness of 1.5 μm or less.

According to configuration 2 mentioned above, the centerline average roughness of the surface of the leg portion is 1.5 μm or less. Therefore, adhesion and accumulation of carbon onto the surface of the leg portion can be more reliably prevented, so that resistance to fouling can be further improved.

Configuration 3. A spark plug of the present invention is characterized in that, in configuration 1 or 2 mentioned above, the space has a volume of 130 $mm^3$ to 240 $mm^3$ inclusive.

According to configuration 3 mentioned above, the gas volume is 130 $mm^3$ to 240 $mm^3$ inclusive. Thus, a larger distance can be ensured between the insulator and the metallic shell, whereas the opening portion of the space between the insulator and the metallic shell can be sufficiently narrowed. By virtue of this, the generation of an abnormal spark discharge between the insulator and the metallic shell and the entry of carbon into the space can be more reliably restrained, so that resistance to fouling can be further improved.

Configuration 4. A spark plug of the present invention is characterized in that, in any one of configurations 1 to 3 mentioned above, the inner circumferential surface of the metallic shell is such that at least a portion thereof which faces the leg portion of the insulator has a centerline average roughness of 0.8 μm or less.

According to configuration 4 mentioned above, the surface of at least a portion of the inner circumferential surface of the metallic shell which faces the leg portion of the insulator (in other words, a portion of the inner circumferential surface which partially defines the space) is smoothed such that the surface of the portion has a centerline average roughness of 0.8 μm or less. Therefore, there can be restrained adhesion and accumulation of carbon onto the surface of a portion of the metallic shell which may generate an abnormal spark discharge in cooperation with the insulator, whereby resistance to fouling can be further improved.

Configuration 5. A spark plug of the present configuration is characterized in that, in any one of configurations 1 to 4 mentioned above, the metallic shell and the insulator satisfy a relation represented by $0.5G \leqq W \leqq 1.5G$, where W is a distance between the insulator and a front end of the metallic shell along a direction orthogonal to the axis, and G is a dimension of the gap.

According to configuration 5 mentioned above, the distance (clearance) W between the insulator and the front end of the metallic shell along the direction orthogonal to the axis is 0.5 times to 1.5 times, inclusive, the dimension G of the gap. That is, by means of a sufficiently large clearance being ensured so as to satisfy the relation $0.5G \leqq W$, there can be more reliably prevented the generation of an abnormal spark discharge (lateral sparking) between the insulator and the front end of the metallic shell. Meanwhile, by means of the relation $W \leqq 1.5G$ being satisfied to thereby relatively narrow the opening portion of the space formed between the metallic shell and the insulator, entry of carbon into the space can be further restrained. In the case where the inner circumferential edge of the front end of the metallic shell is chamfered, the distance W is a distance as measured along the direction orthogonal to the axis between the insulator and the intersection of the front end surface and the inner circumferential surface of the metallic shell.

Configuration 6. A spark plug of the present configuration is characterized in that, in any one of configurations 1 to 5 mentioned above, the metallic shell has a threaded portion to be threadingly engaged with a mounting hole of a combustion apparatus, and the threaded portion has an outside diameter of M10 or less.

Examples of "combustion apparatus" include an internal combustion engine, a combustion reformer having burners, and a boiler having burners.

In recent years, in order to reduce the diameter of a spark plug, reducing the diameters of an insulator and a metallic shell has been conducted. In order to ensure sufficient mechanical strength for the metallic shell, a certain degree of wall thickness must be imparted to the metallic shell. Therefore, the inside diameter of the metallic shell is reduced; consequently, the distance between a leg portion of the insulator and the metallic shell is relatively reduced. In the case of an insulator having a small diameter, even though the amount of accumulation of carbon is relatively small, the carbon may cover the entire leg portion. That is, for a spark plug having a small diameter, ensuring sufficient resistance to fouling is particularly difficult.

In this connection, the spark plug of the present configuration 6 is reduced in diameter such that its threaded portion has an outside diameter of M10 or less, and thus encounters difficulty in ensuring sufficient resistance to fouling. However, through employment of configurations 1 to 5 mentioned above, excellent resistance to fouling can be attained. That is, the configurations mentioned above are particularly useful in application to spark plugs having relatively small outside diameters of M10 or less.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
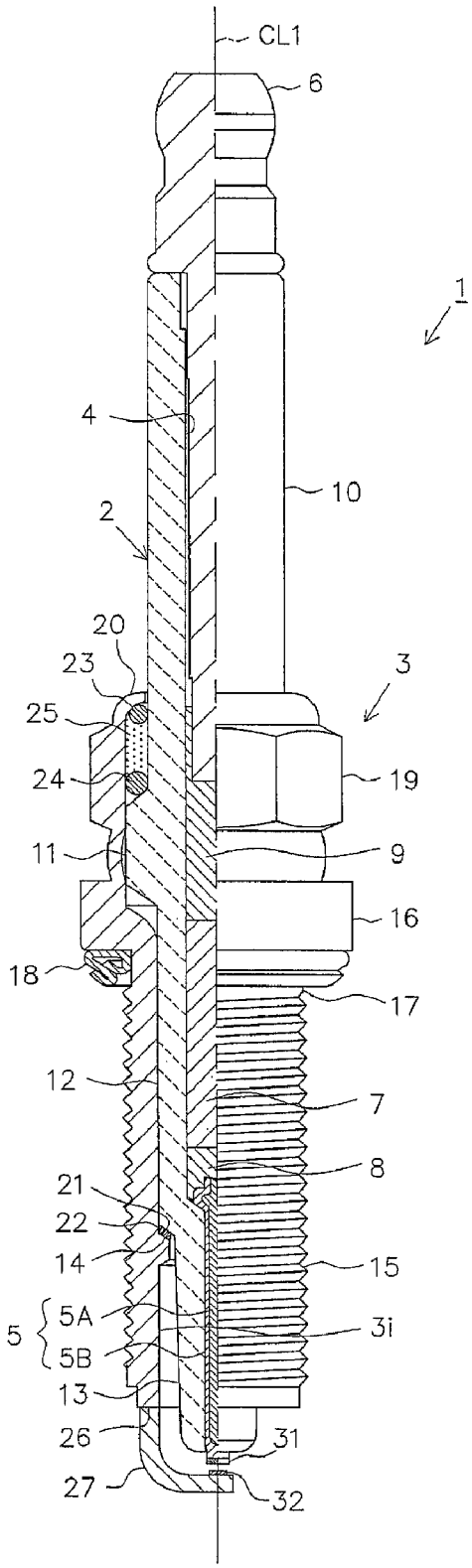
FIG. 1 is a partially cutaway front view showing the configuration of a spark plug according to an embodiment of the present invention.

An embodiment of the present invention will next be described with reference to the drawings. FIG. 1 is a partially cutaway front view showing a spark plug 1. In FIG. 1, the direction of an axis CL1 of the spark plug 1 is referred tows the vertical direction. In the following description, the lower side of the spark plug 1 in FIG. 1 is referred to as the front side of the spark plug 1, and the upper side as the rear side.

The spark plug 1 includes a tubular ceramic insulator 2, which is the insulator in the present invention, and a tubular metallic shell 3, which holds the ceramic insulator 2 therein.

The ceramic insulator 2 is formed from alumina or the like by firing, as well known in the art. The ceramic insulator 2, as viewed externally, includes a rear trunk portion 10 formed on the rear side; a large-diameter portion 11, which is located forward of the rear trunk portion 10 and projects radially outward; and an intermediate trunk portion 12, which is located forward of the large-diameter portion 11 and is smaller in diameter than the large-diameter portion 11. The ceramic insulator 2 also includes a leg portion 13, which is located forward of the intermediate trunk portion 12 and is smaller in diameter than the intermediate trunk portion 12. When the spark plug 1 is mounted to, for example, an internal combustion engine, which is an combustion apparatus, the leg portion 13 is exposed to a combustion chamber of the internal combustion engine. Additionally, A tapered, stepped portion 14 is formed at a transitional portion between the leg portion 13 and the intermediate trunk portion 12. The ceramic insulator 2 is seated on the metallic shell 3 at the stepped portion 14.

Further, the ceramic insulator 2 has an axial hole 4 extending therethrough along the axis CL1. A center electrode 5 is fixedly inserted into a front end portion of the axial hole 4. The center electrode 5 assumes a rodlike (circular columnar) shape as a whole; has a flat front end surface; and projects from the front end of the ceramic insulator 2. The center electrode 5 includes an inner layer 5A made of copper or a copper alloy, and an outer layer 5B made of an Ni alloy which contains nickel (Ni) as a main component. Further, a circular columnar noble metal tip 31 made of a noble metal alloy (e.g., an iridium alloy) is joined to a front end portion of the center electrode 5.

A terminal electrode 6 is fixedly inserted into a rear end portion of the axial hole 4 and projects from the rear end of the ceramic insulator 2.

Further, a circular columnar resistor 7 is disposed within the axial hole 4 between the center electrode 5 and the terminal electrode 6. Opposite end portions of the resistor 7 are electrically connected to the center electrode 5 and the terminal electrode 6 via electrically conductive glass seal layers 8 and 9, respectively.

Additionally, the metallic shell 3 is formed into a tubular shape from a low-carbon steel or a like metal. The metallic shell 3 has a threaded portion (externally threaded portion) 15 on its outer circumferential surface. The threaded portion 15 is adapted to mount the spark plug 1 to a combustion apparatus. The metallic shell 3 has a seat portion 16 formed on its outer circumferential surface and located rearward of the threaded portion 15. A ring-like gasket 18 is fitted to a screw neck 17 located at the rear end of the threaded portion 15. Also, the metallic shell 3 has a tool engagement portion 19 provided near its rear end. The tool engagement portion 19 has a hexagonal cross section and allows a tool such as a wrench to be engaged therewith when the metallic shell 3 is to be mounted to the combustion apparatus. Further, the metallic shell 3 has a crimp portion 20 provided at its rear end portion and adapted to hold the ceramic insulator 2. In the present embodiment, the spark plug 1 is relatively reduced in diameter such that the threaded portion 15 has an outside diameter of M10 or less.

Also, the metallic shell 3 has a tapered support portion 21 provided on its inner circumferential surface 3*i* and adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the support portion 21 of the metallic shell 3, a rear-end opening portion of the metallic shell 3 is crimped radially inward; i.e., the crimp portion 20 is formed, whereby the ceramic insulator 2 is fixed in place. An annular sheet packing 22 intervenes between the stepped portion 14 of the ceramic insulator 2 and the support portion 21 of the metallic shell 3. This retains gastightness of a combustion chamber and prevents leakage of air-fuel mixture to the exterior of the spark plug 1 through a clearance between the inner circumferential surface 3*i* of the metallic shell 3 and the leg portion 13 of the ceramic insulator 2, which leg portion 13 is exposed to the combustion chamber.

Further, in order to ensure gastightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 via the sheet packing 22, the ring members 23 and 24, and the talc 25.

Figure 2:
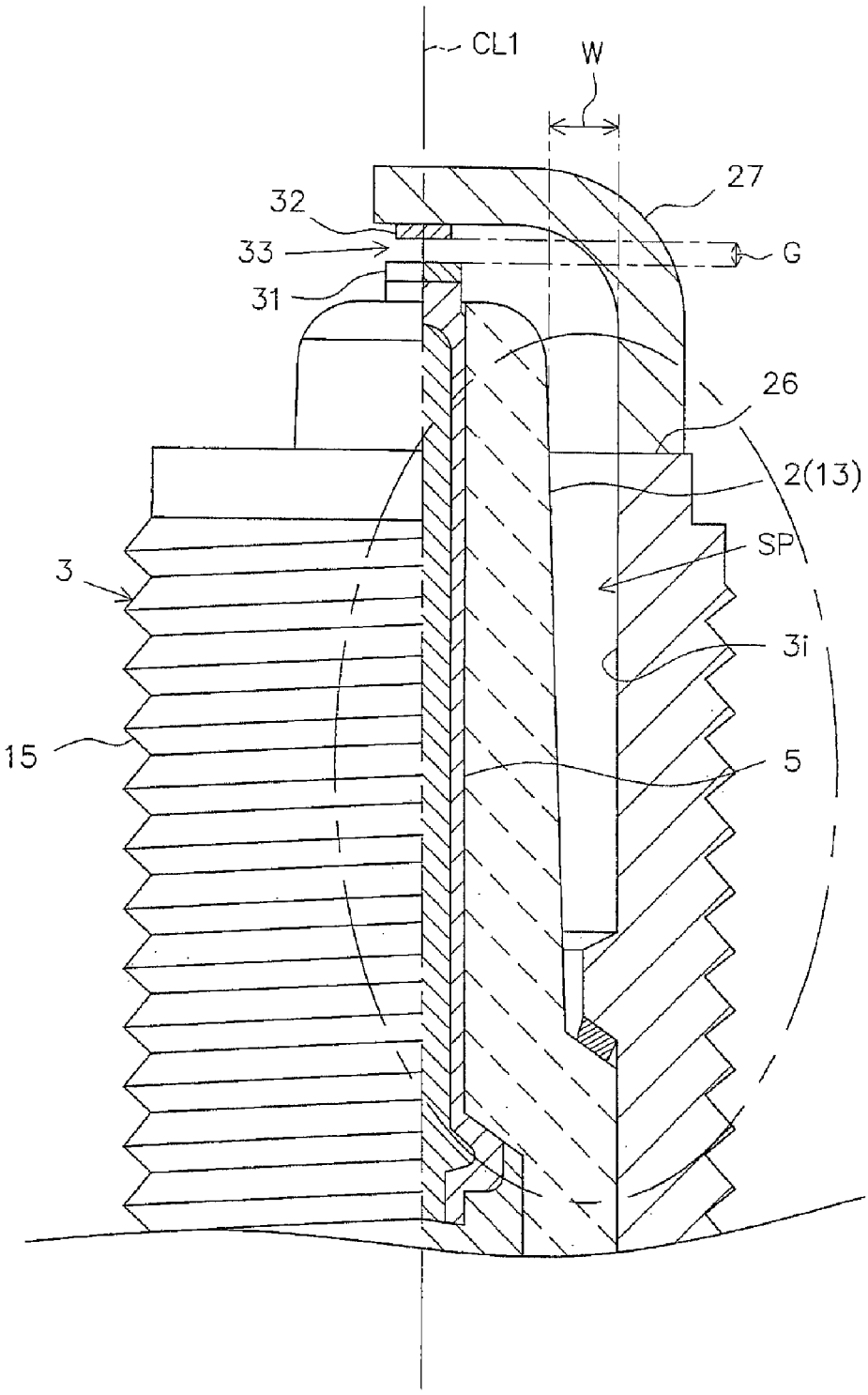
FIG. 2 is an enlarged partially cutaway view showing the configuration of a front end portion of the spark plug.

Also, a ground electrode 27 made of an Ni alloy is joined to the front end portion 26 of the metallic shell 3. Additionally, a circular columnar noble metal tip 32 made of a noble metal alloy (e.g., a platinum alloy) is joined to a distal end portion of the ground electrode 27. As shown in FIG. 2, a spark discharge gap 33, which is the gap in the present invention, is formed between the noble metal tip 31 and the noble metal tip 32. Spark discharges are generated across the spark discharge gap 33 substantially along the axis CL1.

Figure 3:
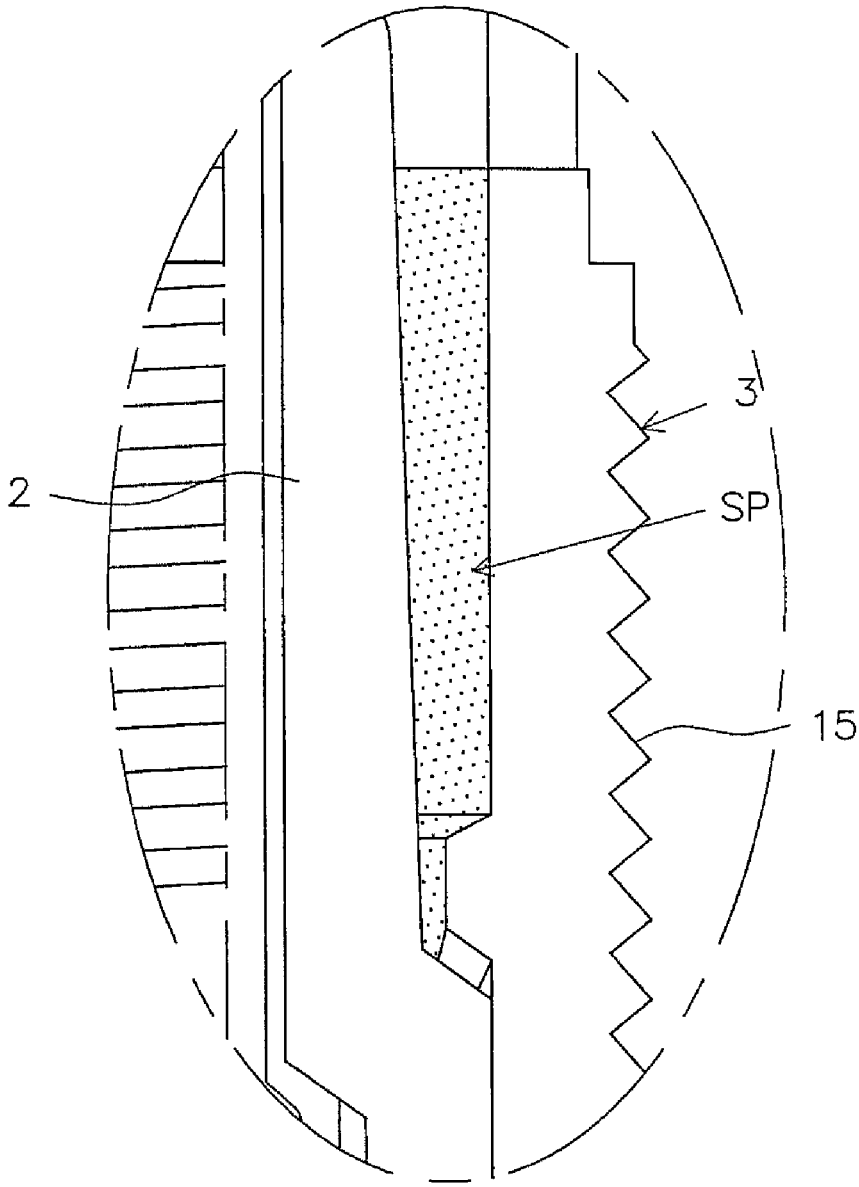
FIG. 3 is a schematic sectional view for explaining a space between a leg portion of a ceramic insulator and the inner circumferential surface of a metallic shell.

Further, in the present embodiment, as shown in FIG. 3 (which shows a region surrounded by the dash-dot line of FIG. 2), a space SP (the dotted region in FIG. 3) formed between the leg portion 13 of the ceramic insulator 2 and the inner circumferential surface 3*i* of the metallic shell 3 has a volume (hereinafter, referred to as the "gas volume") of 100 $mm^3$ to 300 $mm^3$ inclusive. When the spark plug 1 is mounted to, for example, an internal combustion engine, the space SP communicates with the internal space of a combustion chamber of the internal combustion engine.

In addition, the surface of the leg portion 13 is polished so as to have a centerline average roughness of 1.8 μm or less (e.g., 1.5 μm or less). The "centerline average roughness" can be measured by use of, for example, noncontact-type three-dimensional measuring equipment (NH-3, product of Mitaka Kohki Co., Ltd.).

Referring back to FIG. 2, a portion of the inner circumferential surface 3*i* of the metallic shell 3 which faces the leg portion 13 is smoothed so as to have a centerline average roughness of 0.8 μm or less.

Additionally, when G represents the dimension of the spark discharge gap 33, and W represents the distance (clearance) between the front end portion 26 of the metallic shell 3 and the insulator 2 (leg portion 13) along the direction orthogonal to the axis CL1, the dimension G of the spark discharge gap 33 and relevant parameters are adjusted so as to satisfy the relation $0.5G \leqq W \leqq 1.5G$.

Next, a method of manufacturing the spark plug 1 configured as mentioned above is described. First, the metallic shell 3 is formed beforehand. Specifically, a circular columnar metal material (e.g., an iron-based material, such as S17C or S25C, or a stainless steel material) is subjected to cold forging for forming a through hole and a general shape. Subsequently, machining is conducted so as to adjust the outline, thereby yielding a metallic-shell intermediate. The through hole is shaped by subjecting the metallic-shell intermediate to a lathing process performed by use of a predetermined through-hole-forming jig. The lathing process is performed at a predetermined rotational speed with a relatively low feed rate. By this procedure, the surface of the through hole (i.e., the inner circumferential surface 3*i* of the metallic shell 3) is smoothed (has a centerline average roughness of 0.8 μm or less).

Then, the ground electrode 27 having the form of a straight rod and formed of an Ni alloy is resistance-welded to the front end surface of the metallic-shell intermediate. The resistance welding is accompanied by formation of so-called "sags." After the "sags" are removed, the threaded portion 15 is formed in a predetermined region of the metallic-shell intermediate by rolling. Thus, the metallic shell 3 to which the ground electrode 27 is welded is obtained. The metallic shell 3 to which the ground electrode 27 is welded is subjected to galvanization or nickel plating. In order to enhance corrosion resistance, the plated surface may be further subjected to chromate treatment. Subsequently, plating is removed from a distal end portion of the ground electrode 27.

Separately from preparation of the metallic shell 3, the ceramic insulator 2 is formed. For example, a forming material of granular substance is prepared by use of a material powder which contains alumina in a predominant amount, a binder, etc. By use of the prepared forming material of granular substance, a tubular green compact is formed by rubber press forming. The thus-formed green compact is subjected to a grinding process for shaping its outline. The grinding process is performed by use of a grinding wheel having relatively low surface roughness such that the surface of at least a portion of the green compact corresponding to the leg portion 13 is relatively smoothed. The thus-shaped green compact is placed in a kiln, followed by firing. Thus is yielded the ceramic insulator 2 having the leg Portion 13 whose surface has a centerline average roughness of 1.8 μm or less.

The smaller the centerline average roughness of the surface of the leg portion 13, the more preferred. However, in order to attain a centerline average roughness of less than 0.2 μm, the insulator 2 yielded by firing must be subjected town additional polishing process or the like. Therefore, in view of restraining increase in manufacturing cost, preferably, the centerline average roughness of the surface of the leg portion 13 is to such a degree as to be attainable without need to perform the additional polishing process or the like after firing; i.e., the surface of the leg portion 13 has a centerline average roughness of 0.2 μm or greater.

Also, separately from preparation of the metallic shell 3 and the ceramic insulator 2, the center electrode 5 is formed. Specifically, an Ni alloy prepared such that a copper alloy is disposed in a central portion thereof for the purpose of enhancing heat radiation is subjected to forging, thereby forming the center electrode 5. Next, the noble metal member 31 is joined to a front end portion of the center electrode 5 by laser welding or the like.

Then, the ceramic insulator 2 and the center electrode 5, which are formed as mentioned above, the resistor 7, and the terminal electrode 6 are fixed in a sealed condition by means of the glass seal layers 8 and 9. In order to form the glass seal layers 8 and 9, generally, a mixture of borosilicate glass and a metal powder is prepared, and the prepared mixture is charged into the axial hole 4 of the ceramic insulator 2 such that the resistor 7 is sandwiched therebetween. Subsequently, the resultant assembly is heated in a kiln in a condition in which the charged mixture is pressed from the rear by the terminal electrode 6, thereby being fired and fixed. At this time, a glaze layer may be simultaneously fired on the surface of the rear trunk portion 10 of the ceramic insulator 2; alternatively, the glaze layer may be formed beforehand.

Subsequently, the thus-formed ceramic insulator 2 having the center electrode 5 and the terminal electrode 6, and the metallic shell 3 having the ground electrode 27 are assembled together. More specifically, a relatively thin-walled rear-end opening portion of the metallic shell 3 is crimped radially inward; i.e., the above-mentioned crimp portion 20 is formed, thereby fixing the ceramic insulator 2 and the metallic shell 3 together.

Next, the noble metal tip 32 is resistance-welded to the distal end portion, from which plating is removed, of the ground electrode 27. Finally, the distal end portion of the ground electrode 27 is bent toward the center electrode 5, thereby adjusting the spark discharge gap 33 between the noble metal tips 31 and 32. Thus, the spark plug 1 described above is yielded.

As described in detail above, according to the present embodiment, the space formed between the leg portion 13 of the ceramic insulator 2 and the inner circumferential surface 3*i* of the metallic shell 3 has a volume (gas volume) of 100 $mm^3$ or greater. Thus, a relatively large distance can be ensured between the ceramic insulator 2 and the metallic shell 3, whereby the generation of a spark discharge between the ceramic insulator 2 and the metallic shell 3 can be reliably prevented. On the other hand, since the gas volume is specified to be 300 $mm^3$ or less, excessive expansion of an opening portion of the space SP can be restrained, so that entry of carbon into the space SP can be restrained.

Further, the leg portion 13 is smoothed such that its surface has a centerline average roughness of 1.8 μm or less. That is, the surface of the leg portion 13 is almost free from such irregularities where carbon is caught or trapped. Therefore, adhesion and accumulation of carbon onto the surface of the leg portion 13 can be reliably prevented.

As mentioned above, the present embodiment can drastically improve resistance to fouling through synergy of the above-mentioned actions and effects.

Also, at least a portion of the inner circumferential surface 3*i* of the metallic shell 3 which faces the leg portion 13 of the insulator 2 (in other words, a portion of the inner circumferential surface 3*i* which partially defines the space SP) is smoothed such that the portion of the inner circumferential surface 3*i* has a centerline average roughness of 0.8 μm or less. Therefore, there can be restrained adhesion and accumulation of carbon onto the portion of the inner circumferential surface 3*i* which may generate an abnormal spark discharge in cooperation with the ceramic insulator 2, whereby resistance to fouling can be further improved.

In addition, the distance (clearance) W between the ceramic insulator 2 and the front end portion 26 of the metallic shell 3 along the direction orthogonal to the axis CL1 is 0.5 times to 1.5 times, inclusive, the dimension G of the spark discharge gap 33. That is, by means of the clearance being ensured so as to satisfy the relation $0.5G \leqq W$, there can be more reliably prevented the generation of an abnormal spark discharge (lateral sparking) between the ceramic insulator 2 and the front end portion 26 of the metallic shell 3. Meanwhile, by means of the relation $W \leqq 1.5G$ being satisfied to thereby relatively narrow the opening portion of the space SP formed between the metallic shell 3 and the ceramic insulator 2, entry of carbon into the space SP can be further restrained.

Figure 4:
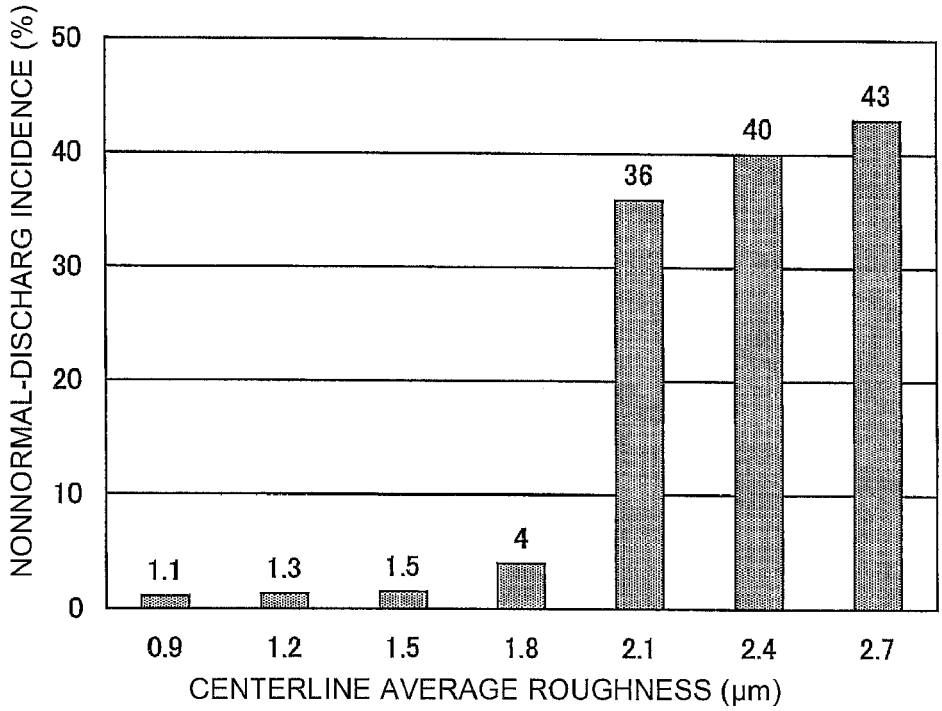
FIG. 4 is a graph showing the relation between the incidence of nonnormal discharge and the centerline average roughness of the surface of the leg portion in a resistance-to-fouling evaluation test.

Next, in order to verify actions and effects yielded by the present embodiment, there were fabricated spark plug samples that differed in the centerline average roughness of the surface of the leg portion. The spark plug samples were subjected to a resistance-to-fouling evaluation test. The resistance-to-fouling evaluation test is the "carbon fouling test" specified in JIS D1606 and is described in detail below. A test automobile having a 4-cylinder engine of 1,600 cc displacement is placed on a chassis dynamometer within a low-temperature test room (−10° C.). Four spark plug samples are mounted to respective cylinders of the engine of the test automobile. One cycle of test pattern sequentially consists of three times of racing, a 40-second run at 35 km/h with the third gear position, 90-second idling, a 40-second run at 35 km/h with the third gear position, engine halt and cooling, three times of racing, three 20-second runs at 15 km/h with the first gear position with 30-second engine halts therebetween, and engine stop. The test pattern was repeated for 10 cycles, and then the engine was brought to an idling operation. During the idling operation, discharge waveforms associated with voltage applied to the samples were obtained. From the obtained discharge waveforms, the ratio of the number of abnormal spark discharges (e.g., current leakage and lateral sparking) to the total number of discharges (incidence of nonnormal discharge) was calculated. The samples had a gas volume of 170 $mm^3$, a spark discharge gap of 1.1 mm, a distance (clearance) between the ceramic insulator and the front end portion of the metallic shell along the direction orthogonal to the axis of 1.4 mm, and a centerline average roughness of the inner circumferential surface of the metallic shell of 0.8 μm. FIG. 4 is a graph showing the relation between the incidence of nonnormal discharge and the centerline average roughness of the surface of the leg portion.

As shown in FIG. 4, the samples having a centerline average roughness of the surface of the leg portion of 1.8 μm or less exhibited an incidence of nonnormal discharge of 5% or less, indicating that the samples have excellent resistance to fouling. Conceivably, this is for the following reason: employment of a centerline average roughness of the surface of the leg portion of 1.8 μm or less effectively restrained adhesion and accumulation of carbon onto the leg portion, which causes abnormal spark discharge. Particularly, the samples having a centerline average roughness of the surface of the leg portion of 1.5 μm or less exhibited an incidence of nonnormal discharge of 2% or less, indicating that the samples have quite excellent resistance to fouling.

Figure 5:
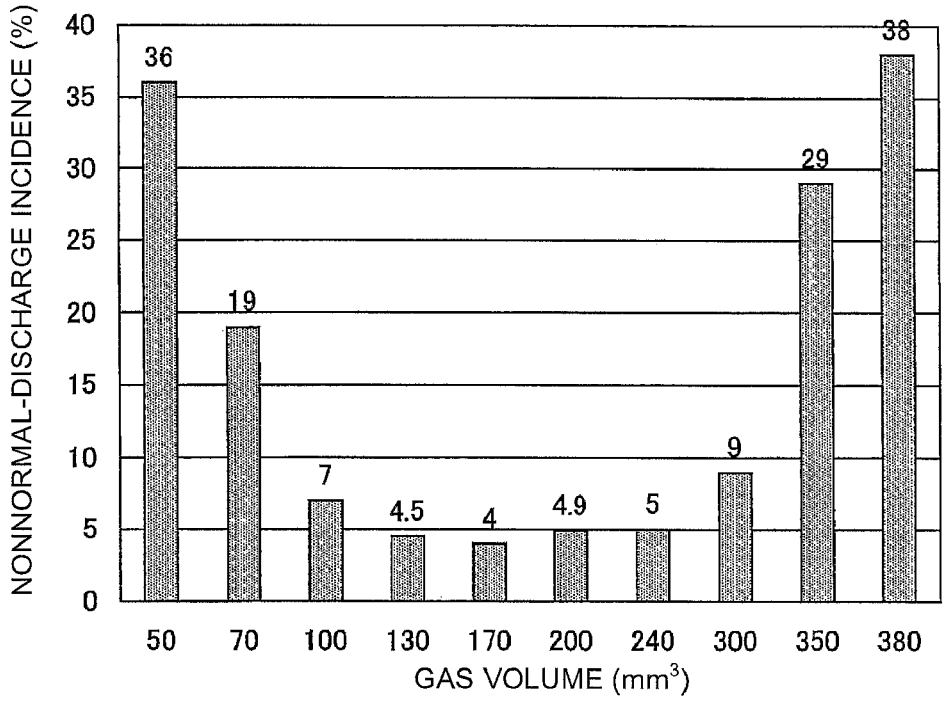
FIG. 5 is a graph showing the relation between the gas volume and the incidence of nonnormal discharge in the resistance-to-fouling evaluation test.

Next, spark plug samples having different gas volumes were fabricated while the surface of the leg portion had a centerline average roughness of 1.8 μm. The samples were subjected to the resistance-to-fouling evaluation test mentioned above. The spark discharge gap and other parameters were the same as those of the test mentioned above. FIG. 5 is a graph showing the relation between the gas volume and the incidence of nonnormal discharge.

As shown in FIG. 5, the samples having a gas volume of 100 $mm^3$ to 300 $mm^3$ inclusive exhibited an incidence of nonnormal discharge of 10% or less, indicating that the samples have sufficient resistance to fouling. Conceivably, this is for the following reason: since the specification of a gas volume of 100 $mm^3$ or greater ensured a relatively large distance between the ceramic insulator and the metallic shell, the generation of abnormal spark discharge therebetween was restrained; and the specification of a gas volume of 300 $mm^3$ or less restrained excessive entry of carbon into the space between the ceramic insulator and the metallic shell. Particularly, the samples having a gas volume of 130 $mm^3$ to 240 $mm^3$ exhibited an incidence of nonnormal discharge of 5% or less, indicating that the samples have excellent resistance to fouling.

Figure 6:
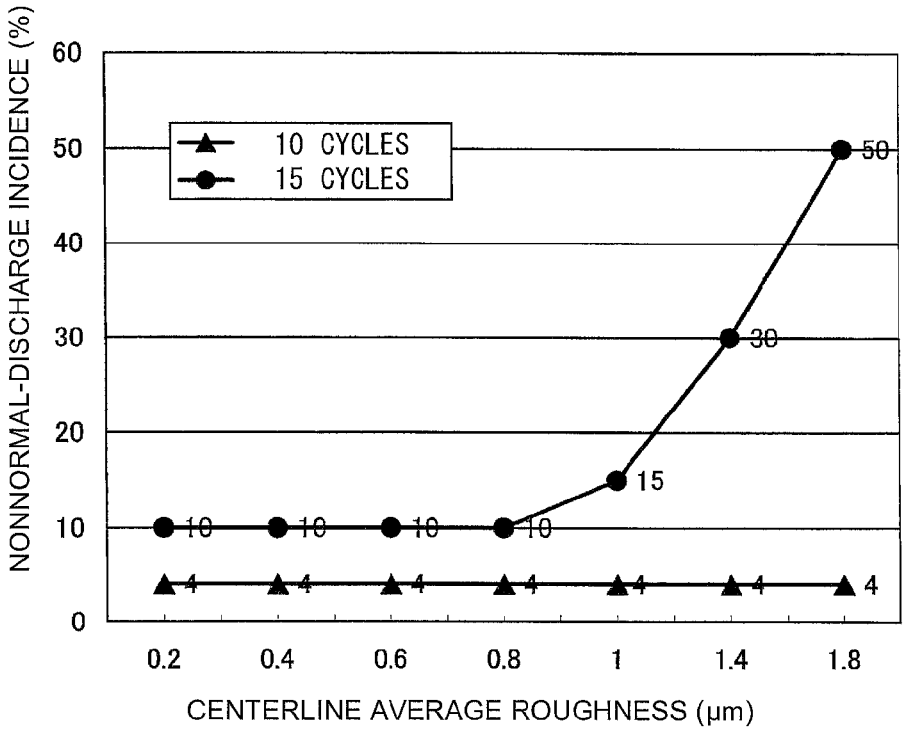
FIG. 6 is a graph showing the relation between the incidence of nonnormal discharge and the centerline average roughness of the inner circumferential surface of the metallic shell in the resistance-to-fouling evaluation test.

Next, there were fabricated spark plug samples that differed in the centerline average roughness of the inner circumferential surface of the metallic shell while the centerline average roughness of the surface of the leg portion was 1.8 μm, and the gas volume was 170 $mm^3$. The samples were measured for the incidence of nonnormal discharge for the case where the resistance-to-fouling evaluation test mentioned above was conducted such that the test pattern was repeated for 10 cycles, and the incidence of nonnormal discharge for the case where the resistance-to-fouling evaluation test mentioned above was conducted such that the test pattern was repeated for 15 cycles. The spark discharge gap and other parameters were the same as those of the test mentioned above. FIG. 6 is a graph showing the relation between the incidence of nonnormal discharge and the centerline average roughness of the inner circumferential surface of the metallic shell. In FIG. 6, the incidence of nonnormal discharge in the case of 10 cycles is plotted in black triangles, and the incidence of nonnormal discharge in the case of 15 cycles is plotted in heavy dots.

As shown in FIG. 6, in the case of 10 cycles, regardless of difference in the centerline average roughness of the inner circumferential surface of the metallic shell, the samples exhibited a constant incidence of nonnormal discharge of 4%. In the case of 15 cycles; i.e., in the case of a condition in which carbon was more likely to adhere and accumulate, the samples having a centerline average roughness of the inner circumferential surface of the metallic shell of 0.8 μm or less exhibited an incidence of nonnormal discharge of 10% or less, indicating that, even in a condition in which fouling is apt to progress, the samples have excellent resistance to fouling. Conceivably, this is for the following reason. By virtue of impartment of a relatively low surface roughness to the inner circumferential surface of the metallic shell, adhesion and accumulation of carbon onto the inner circumferential surface of the metallic shell was restrained, whereby the generation of abnormal spark discharge between the metallic shell and the ceramic insulator was restrained.

Figure 7:
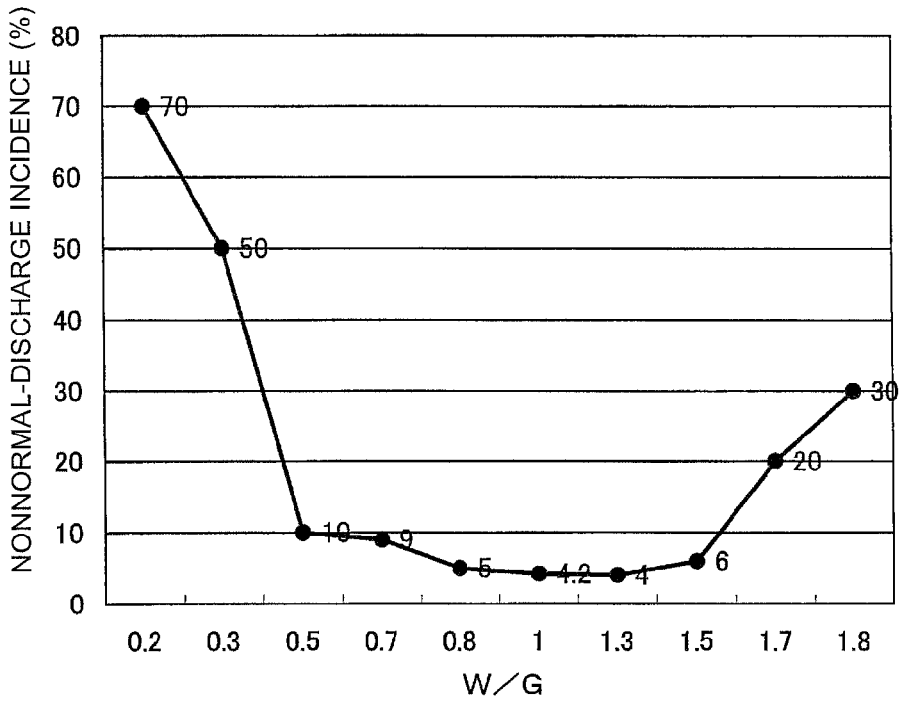
FIG. 7 is a graph showing the relation between the incidence of nonnormal discharge and the ratio of a clearance to a spark discharge gap in the resistance-to-fouling evaluation test.

Next, there were fabricated spark plug samples that differed in the ratio (W/G) of the distance (clearance) W between the ceramic insulator and the front end portion of the metallic shell along the direction orthogonal to the axis to the dimension G of the spark discharge gap. The samples were subjected to the aforementioned resistance-to-fouling evaluation test conducted such that the test pattern was repeated for 15 cycles. FIG. 7 is a graph showing the relation between W/G and the incidence of nonnormal discharge.

As shown in FIG. 7, even in a condition in which fouling was apt to progress, the samples which satisfied the relation represented by $0.5 \leqq W/G \leqq 1.5$ exhibited an incidence of nonnormal discharge of 10% or less, indicating that the samples have sufficient resistance to fouling. Conceivably, this is for the following reason. The specification of $0.5 \leqq W/G$ ensured a sufficiently large clearance, thereby restraining the generation of abnormal spark discharge between the insulator and the front end of the metallic shell. Also, the specification of $W \leqq 1.5G$ relatively narrowed the opening portion of the space formed between the insulator and the metallic shell, whereby entry of carbon into the space was restrained.

In view of the evaluation test results mentioned above, employing a centerline average roughness of the surface of the leg portion of 1.8 μl or less and a gas volume of 100 $mm^3$ to 300 $mm^3$ inclusive is useful for improvement of resistance to fouling. Also, for further improvement of resistance to fouling, employing a centerline average roughness of the surface of the leg portion of 1.5 μm or less, a gas volume of 130 $mm^3$ to 240 $mm^3$ inclusive, a centerline average roughness of the inner circumferential surface of the metallic shell of 0.8 μm or less, or the relation $0.5 \leqq W/G \leqq 1.5$ is useful.

The present invention is not limited to the above-described embodiments, but may be embodied, for example, as follows. Of course, application examples and modifications other than those described below are also possible.

(a) In the above embodiment, the ceramic insulator 2 is engaged indirectly with the metallic shell 3 via the sheet packing 22. However, the ceramic insulator 2 may be engaged directly with the metallic shell 3 without use of the intervening sheet packing 22.

(b) In the above embodiment, an internal combustion engine is mentioned as an example of combustion apparatus. However, a combustion apparatus which can use the spark plug 1 is not limited to the internal combustion engine. For example, the spark plug 1 may be used to light a burner of a combustion reformer, a burner of a boiler, etc.

(c) In the above embodiment, the noble metal tips 31 and 32 are provided. However, one of or both of the noble metal tips 31 and 32 may be eliminated.

(d) In the above embodiment, the ground electrode 27 is joined to the front end of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906).

(e) In the above embodiment, the tool engagement portion 19 has a hexagonal cross section. However, the shape of the tool engagement portion 19 is not limited thereto. For example, the tool engagement portion 19 may have a Bi-HEX (modified dodecagonal) shape [IS022977:2005(E)] or the like.

DESCRIPTION OF REFERENCE NUMERALS

1: spark plug; 2: ceramic insulator (insulator); 3: metallic shell; 3*i*: inner circumferential surface of metallic shell; 4: axial hole; 5: center electrode; 13: leg portion; 14: stepped portion; 15: threaded portion; 21: support portion; 27: ground electrode; 33: spark discharge gap (gap); CL1: axis.

The invention claimed is:

1. A spark plug comprising:

a rodlike center electrode extending in a direction of an axis;

a tubular insulator having an axial hole which extends in the direction of the axis and in which the center electrode is provided;

a cylindrical metallic shell provided externally of an outer circumference of the insulator and having a support portion which is formed on an inner circumferential surface thereof, is in direct or indirect contact with an outer circumferential surface of the insulator, and supports the insulator; and a ground electrode extending from a front end portion of the metallic shell and defines, in cooperation with the center electrode, a gap between a distal end portion thereof and a front end portion of the center electrode;

wherein, the insulator has a stepped portion supported by the support portion of the metallic shell, and a leg portion formed forward of the stepped portion along the direction of the axis; and characterized in that a space formed between the leg portion of the insulator and the inner circumferential surface of the metallic shell has a volume of 100 $mm^3$ to 300 $mm^3$ inclusive, and a surface of the leg portion has a centerline average roughness of 1.8 μm or less.

2. A spark plug according to claim 1, wherein the surface of the leg portion has a centerline average roughness of 1.5 μm or less.

3. A spark plug according to claim 1, wherein the space has a volume of 130 $mm^3$ to 240 $mm^3$ inclusive.

4. A spark plug according to claim 1, wherein the inner circumferential surface of the metallic shell is such that at least a portion thereof which faces the leg portion of the insulator has a centerline average roughness of 0.8 μm or less.

5. A spark plug according to claim 1, wherein the metallic shell and the insulator satisfy a relation represented by $0.5G \leqq W \leqq 1.5G$, where W is a distance between the insulator and a front end of the metallic shell along a direction orthogonal to the axis, and G is a dimension of the gap.

6. A spark plug according to claim 1, wherein the metallic shell has a threaded portion that threadingly engages with a mounting hole of a combustion apparatus, and the threaded portion has an outside diameter of M10 or less.

7. A spark plug according to claim 2, wherein the space has a volume of 130 $mm^3$ to 240 $mm^3$ inclusive.

8. A spark plug according to claim 2, wherein the inner circumferential surface of the metallic shell is such that at least a portion thereof which faces the leg portion of the insulator has a centerline average roughness of 0.8 μm or less.

9. A spark plug according to claim 3, wherein the inner circumferential surface of the metallic shell is such that at least a portion thereof which faces the leg portion of the insulator has a centerline average roughness of 0.8 μm or less.

10. A spark plug according to claim 2, wherein the metallic shell and the insulator satisfy a relation represented by $0.5G \leqq W \leqq 1.5G$, where W is a distance between the insulator and a front end of the metallic shell along a direction orthogonal to the axis, and G is a dimension of the gap.

11. A spark plug according to claim 3, wherein the metallic shell and the insulator satisfy a relation represented by $0.5G \leqq W \leqq 1.5G$, where W is a distance between the insulator and a front end of the metallic shell along a direction orthogonal to the axis, and G is a dimension of the gap.

12. A spark plug according to claim 4, wherein the metallic shell and the insulator satisfy a relation represented by 0.5G $G \leqq W \leqq 1.5G$, where W is a distance between the insulator and a front end of the metallic shell along a direction orthogonal to the axis, and G is a dimension of the gap.

13. A spark plug according to claim 2, wherein the metallic shell has a threaded portion that threadingly engages with a mounting hole of a combustion apparatus, and the threaded portion has an outside diameter of M10 or less.

14. A spark plug according to claim 3, wherein the metallic shell has a threaded portion that threadingly engages with a mounting hole of a combustion apparatus, and the threaded portion has an outside diameter of M10 or less.

15. A spark plug according to claim 4, wherein the metallic shell has a threaded portion that threadingly engages with a mounting hole of a combustion apparatus, and the threaded portion has an outside diameter of M10 or less.

16. A spark plug according to claim 5, wherein the metallic shell has a threaded portion that threadingly engages with a mounting hole of a combustion apparatus, and the threaded portion has an outside diameter of M10 or less.

* * * * *